US009784069B1

(12) United States Patent
Bair et al.

(10) Patent No.: US 9,784,069 B1
(45) Date of Patent: Oct. 10, 2017

(54) HYDRAULIC DRAIN FOR OILFIELD SERVICE

(71) Applicant: Black Gold Pump and Supply, Inc., Signal Hill, CA (US)

(72) Inventors: Michael Bair, Los Angeles, CA (US); Scott Sakakura, Los Angeles, CA (US); Simon Shin, Los Angeles, CA (US)

(73) Assignee: Black Gold Pump and Supply, Inc., Signal Hill, CA (US)

( * ) Notice: Subject to any disclaimer, the term of this patent is extended or adjusted under 35 U.S.C. 154(b) by 186 days.

(21) Appl. No.: 14/879,579

(22) Filed: Oct. 9, 2015

(51) Int. Cl.
*E21B 34/06* (2006.01)

(52) U.S. Cl.
CPC ..... *E21B 34/063* (2013.01)

(58) Field of Classification Search
CPC ..... E21B 34/063; E21B 43/12; E21B 43/121; E21B 43/126; E21B 43/127
USPC ..... 166/317
See application file for complete search history.

(56) References Cited

U.S. PATENT DOCUMENTS 4,553,598 A * 11/1985 Meek ..... E21B 34/063 166/264
4,609,005 A * 9/1986 Upchurch ..... E21B 34/063 137/68.22
6,591,915 B2 * 7/2003 Burris ..... E21B 34/063 166/317
6,752,212 B2 * 6/2004 Burris ..... F16K 17/162 166/105
7,090,027 B1 * 8/2006 Williams ..... E21B 33/04 137/68.23
2008/0178938 A1 * 7/2008 Stokes ..... E21B 34/063 137/68.23
2009/0242195 A1 * 10/2009 Wicentovich ..... E21B 43/127 166/244.1
2013/0025872 A1 * 1/2013 Mailand ..... E21B 34/063 166/332.1
2013/0105175 A1 * 5/2013 Mailand ..... E21B 34/06 166/373
2014/0251620 A1 * 9/2014 George ..... E21B 34/108 166/305.1
2015/0275621 A1 * 10/2015 Ringgenberg ..... E21B 34/063 166/378
2015/0292285 A1 * 10/2015 Hrametz ..... E21B 23/08 166/381
2015/0369007 A1 * 12/2015 George ..... E21B 34/108 166/305.1
2016/0003701 A1 * 1/2016 Ringgenberg ..... G01L 9/0033 166/317

* cited by examiner

*Primary Examiner* — Frederick L Lagman
(74) *Attorney, Agent, or Firm* — James M. Duncan, Esq.; Klein DeNatale Goldner

(57) ABSTRACT

A hydraulically actuated tubing drain for service with oil wells, water wells, gas wells and/or thermal wells has a configuration of structural features which, upon hydraulically opening the drain, prevent any debris from the rupture disk from entering either the tubing or the tubing-casing annulus. The disk housing and flow diffuser of the present invention mate directly together, capturing between the disk housing and flow diffuser a shoulder of the mandrel. This design eliminates the need for a threaded aperture through the side wall of the mandrel and the need for elastomeric seals.

13 Claims, 4 Drawing Sheets

HYDRAULIC DRAIN FOR OILFIELD SERVICE

BACKGROUND OF THE INVENTION

This invention relates to devices for draining fluids from a tubing string in a hydrocarbon production well. Tubing drains allow fluids to drain from the tubing string of a well. Among other purposes, draining fluid from the tubing string allows the tubing to be removed from a well without pulling the tubing "wet", which occurs when there is an obstruction in the tubing which prevents the fluid from draining out of the bottom of the tubing. For example, if the well is produced with a rod pump and the rods have parted leaving a pump or plunger at the bottom of the tubing string, the tubing will stand full of fluid unless a drain can be activated to allow the fluid to escape from the tubing into the casing-tubing annulus.

Tubing drains may be either activated by manipulation of the tubing, typically by rotation, or by applying pressure to the tubing string to a sufficiently high pressure to burst one or more rupture disks contained within the tubing drain. While each type drain has its application, the hydraulically activated drains have the advantage that rotation of the tubing is not required to activate the drain. There are situations where rotation of the tubing may not be achievable, such as in highly deviated wells or when downhole tubing or tools are stuck from casing collapse or obstructions. However, there are several disadvantages with the commonly used hydraulic drains.

One disadvantage is that if the rupture disk is unintentionally ruptured, the production equipment—usually comprising a rod string, downhole pump, and tubing string—becomes inoperable and must be removed to change out the hydraulic drain. Unintentional rupturing of the disk can, of course, be caused by the pressuring up of the tubing pressure by some event, such as the accidental closing of a valve on a surface production line. However, other phenomena may also rupture the disk. For example, the movement of rod couplings within the tubing string presents a potential mechanism for rupturing the disk. Physical contact between the rod coupling and the disk can cause rupturing of the disk by the impact by the coupling upon the disk. In addition, the motion of the coupling in close proximity to the hydraulic drain can cause a localized pressure spike resulting from the piston effect of the coupling inside or adjacent to the drain. The likelihood of such premature rupturing of the disk increases with the decrease in clearance between the rod coupling and the inside diameter of the hydraulic drain.

Another disadvantage of hydraulic drains is that many of the drains utilize elastomeric O-ring seals which can degrade over time, particularly in the presence of corrosive wellbore fluid, harsh downhole treatment fluids, high temperatures, and/or high pressures. A seal failure will result in fluid leakage from the tubing which requires the removal of the tubing string to change out the drain.

Another disadvantage of some hydraulic drains is that the rupture disks are unrestrained such that the disk remnants end up inside the well, leaving junk/trash which can either interfere with the operation of downhole equipment or which can accumulate with other debris to create a wellbore obstruction.

Another disadvantage of the known hydraulic drains is that the replacement of a rupture disk within the hydraulic drain typically requires sending the drain into a shop for replacement of the rupture disk and related elastomeric O-ring seals. If the hydraulic drain is of the type which utilizes threads in the mandrel for retaining the rupture disk, the threads may be damaged and require redressing. The life of the drain may be limited if the threads are damaged through repeated use because satisfactory repair of the threads may not be possible, which means the mandrel can no longer be used.

SUMMARY OF THE INVENTION

Embodiments of the method and apparatus disclosed herein provide a solution to the problems described above. For purposes of this disclosure, the terms "lower," "bottom," "downward," etc., refer to a direction facing toward the bottom of a well and the terms "upper," "top," "up," etc., refer to a direction facing toward the surface. The terms "inward" and "inwardly" refer to a direction facing toward the central axis of the disclosed hydraulic drain and the terms "outward" and "outwardly" refer to a direction facing towards the inside wall of the casing string.

An embodiment of the apparatus is utilized in hydrocarbon producing wells for draining a tubing string which is disposed within a length of well casing. Embodiments of the apparatus have a mandrel which is made up into the tubing string, typically with either a pin-to-pin configuration where the mandrel has threaded male ends on each end which are made up into tubing couplings, or a pin-to-box configuration, where the mandrel has a box with internal threads on one end for receiving a threaded male pin and a pin with external threads on the opposing end. Using the terms defined above, the upward end may have either a pin with external threads or a box within internal threads, while the lower end, in accord with standard oilfield practice, may have a pin with external threads, but may also have box with internal threads if desired.

The mandrel has an axially-aligned opening which has an inside diameter which, in accord with oilfield practice, is typically at least as large as the inside diameter of the tubing comprising the tubing string. The mandrel has an interior portion typically, but not necessarily, located in the approximate middle of the length of the mandrel. Penetrating through the mandrel wall from the interior portion of the mandrel to the exterior of the mandrel is an aperture which is generally perpendicular to the long axis of the mandrel. The aperture comprises, in relative position between the inside of the mandrel wall and the outside of the mandrel wall, a first section having a first diameter and a second section having a second diameter. A first circumferential shoulder (hereinafter "first shoulder") is defined between the first diameter and the second diameter. This first shoulder has an outward face (i.e, facing toward the exterior of the mandrel) and an inward face facing the interior of the mandrel. The inward face may comprise a first sloping sealing surface.

A flow diffuser is disposed within the aperture. The flow diffuser has an inside end facing the interior of the mandrel and an outside end which, when installed, faces outwardly toward the well casing. The flow diffuser comprises one or more flow passages which extend from the inside end to the outside end, where the flow passages provide a path for evacuating the fluid within the tubing when the rupture disk has been burst. The flow diffuser has a threaded section which is adjacent to the inside end.

The hydraulic drain also has a disk housing which has an exterior end which is placed in facing relationship with the flow diffuser and an interior end which faces the interior portion of the mandrel. The exterior end of the disk housing has a threaded section, where the threaded section of the disk housing is adapted to make up to the threaded section of the flow diffuser. A rupture disk is disposed between the exterior end and the interior end of the disk housing.

When the threads of the disk housing are made up to the threads of the flow diffuser, the first shoulder within the aperture is sandwiched between the disk housing and the flow diffuser, with a metal-to-metal seal formed between the diffuser/disk housing combination and the walls of the aperture. This design eliminates the need for threads within the aperture itself, as used in other hydraulic drains. This design also eliminates the need for O-rings for sealing the flow diffuser/disk housing within the aperture. The elimination of a threaded aperture, having threads which are typically redressed following each use, increases the life of the mandrel. Embodiments of the disclosed invention can be used repeatedly by installing a disk housing having a new rupture disk into the mandrel. The disk housing is pushed up against the aperture from the inside of the mandrel while the flow diffuser is screwed into the disk housing from the outside of the mandrel. Separate tools are utilized to make up the flow diffuser to the disk housing, with a tool both inside and outside the mandrel—one tool holding the disk housing on the inside of the mandrel and the other made up to the flow diffuser on the outside.

DETAILED DESCRIPTION OF THE EMBODIMENTS

Figure 1:
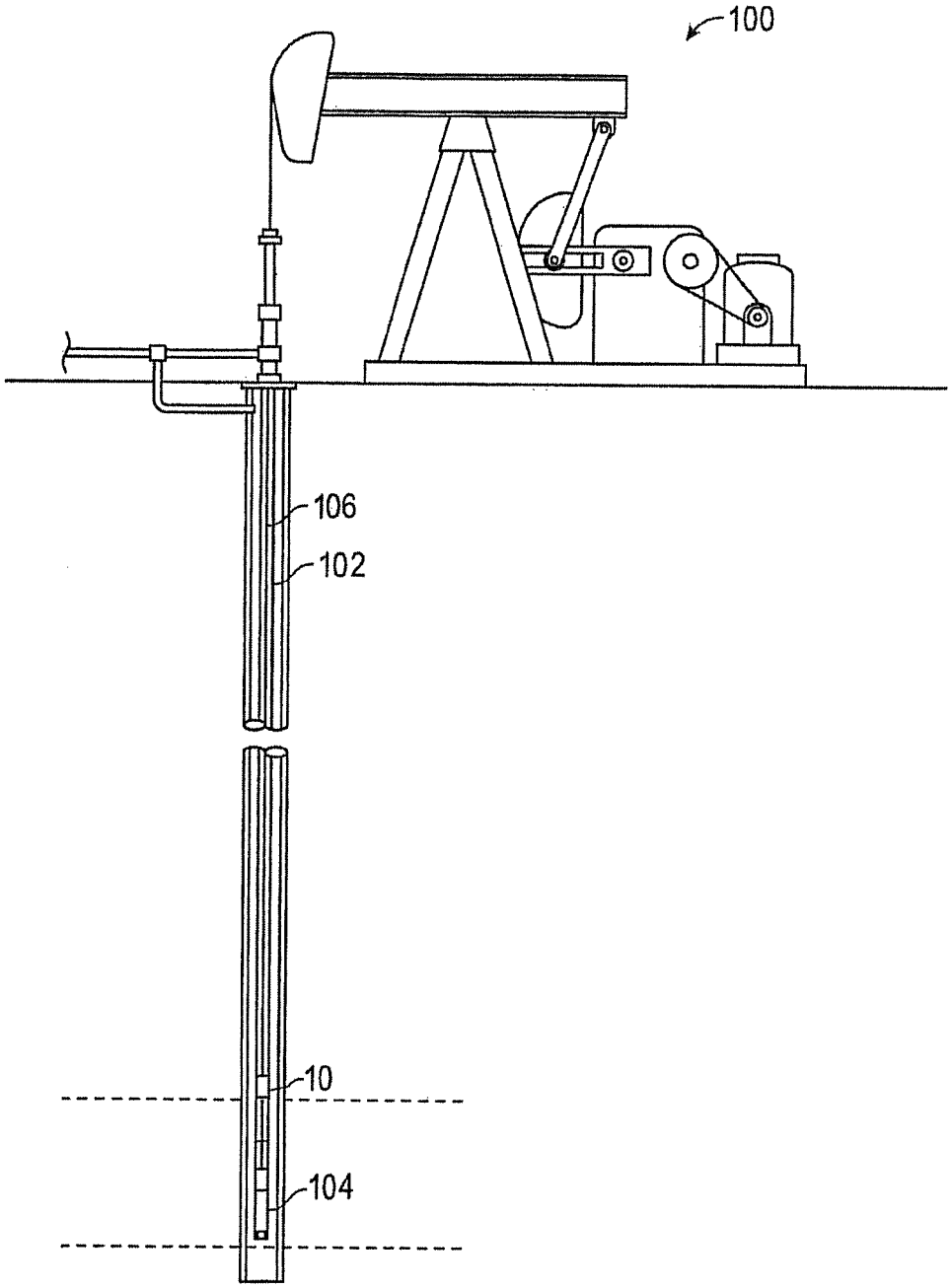
FIG. 1 schematically depicts a hydrocarbon well depicting an embodiment of the present invention located in the tubing string.

Referring specifically to the figures, FIG. 1 schematically shows a hydrocarbon well installation 100. The well installation may have, among other components, a tubing string 102, a downhole pump 104, a rod string 106 which operates the downhole pump, and a hydraulic drain 10 of the present invention. While FIG. 1 shows a hydraulic drain 10 placed in a hydrocarbon production well, the drain may also be utilized in injection wells, monitoring wells, or other wells where it may be desirable to drain fluid from a string of tubing. When the hydraulic drain is activated by applying pressure to the tubing string, the fluid column above the hydraulic drain will drain out of the tubing string into the tubing-casing annulus through flow passages in the drain 10.

Figure 2:
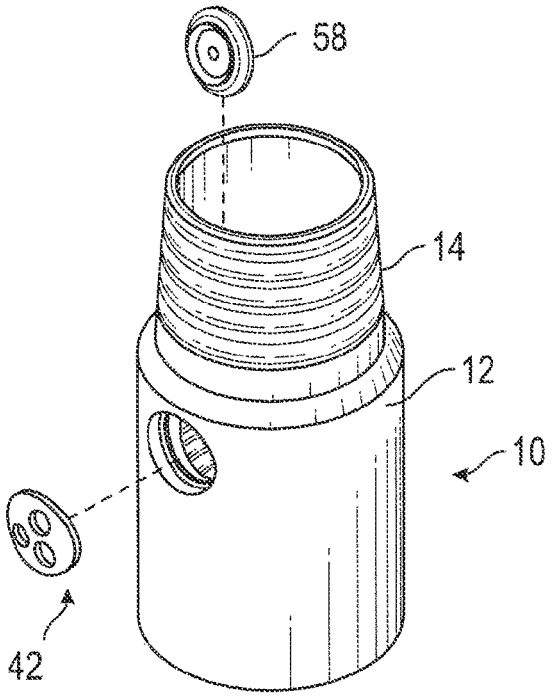
FIG. 2 shows a perspective view of an embodiment of the present invention.
Figure 3:
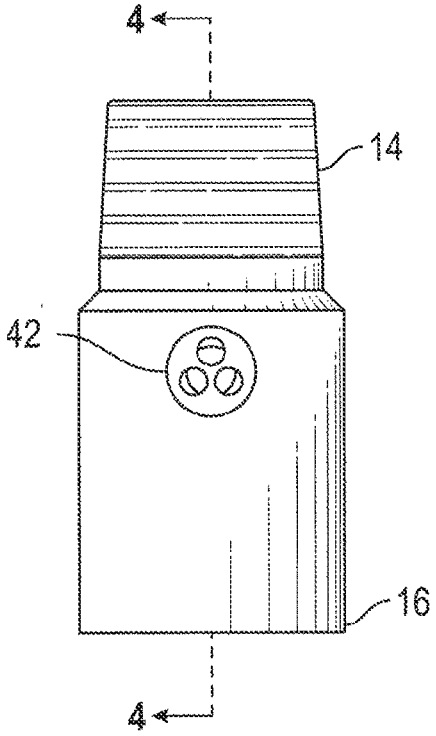
FIG. 3 shows a front view of the embodiment depicted in FIG. 2.

FIG. 2 shows a perspective view of an embodiment of the present hydraulic drain 10. Embodiments of the hydraulic drain 10 have a mandrel 12 which is made up into the tubing string. FIGS. 1-2 show one embodiment in which the mandrel 12 has one end which is a threaded pin 14 which is made up into a coupling of the tubing string. The opposite end 16 of the mandrel will typically have internal threads 18 for receiving a threaded pin from a tubing member.

The mandrel 12 has an axially-aligned opening 20 which extends between the upper end 22 and the lower end 24 of the mandrel 12 where a central axis $L_1$ is defined between the upper end and the lower end. It is to be noted that the terms "upper end" and "lower end" are made with respect to the orientation of the drawing figures only, and that the hydraulic drain 10 may be installed with either end facing upward or downward in a well. Axially-aligned opening 20 will typically have an inside diameter which is at least as large as the inside diameter of the tubing. The largest outside diameter of the hydraulic drain 10 is at the lower end 24. This diameter may be the same diameter as a tubing coupling, which ensures a slim profile for the tool and which mitigates against erosional wear to the hydraulic drain 10 and the inside of the casing as the tubing string and drain are installed in a well. The slim profile also provides more clearance for recovery of the hydraulic drain 10 by a fishing tool, such as an overshot, in the event the apparatus becomes part of a downhole fish.

Figure 4:
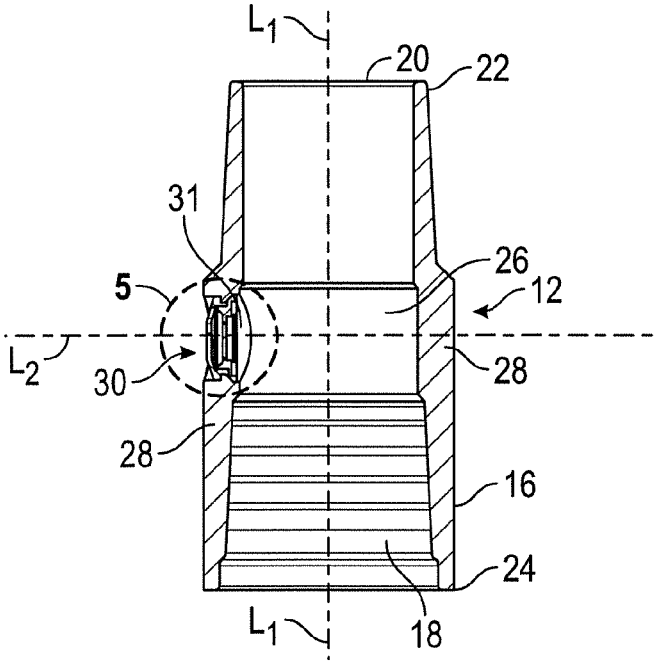
FIG. 4 shows a sectional view from FIG. 3.
Figure 5A:
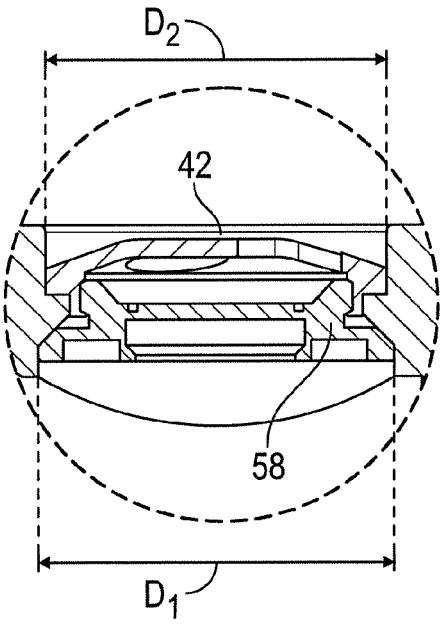
FIG. 5A shows a detailed view of an aperture, disk housing, and flow diffuser from the embodiment depicted in FIG. 4.
Figure 5B:
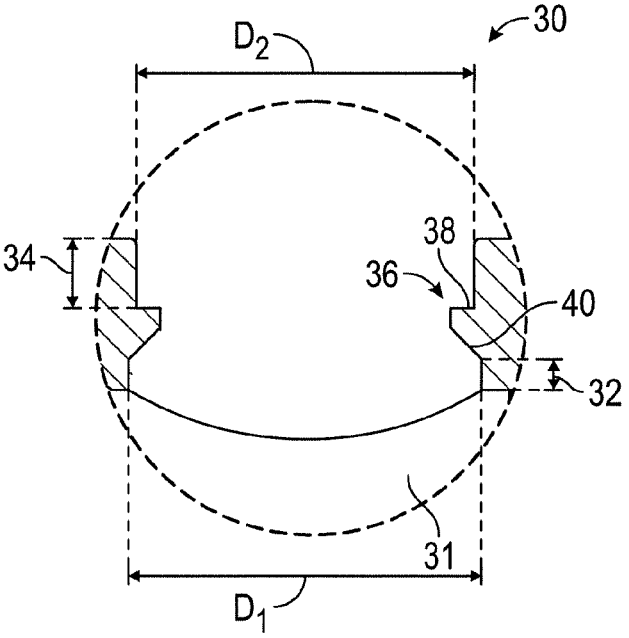
FIG. 5B shows a detailed view of the aperture with the disk housing and flow diffuser removed.
Figure 6:
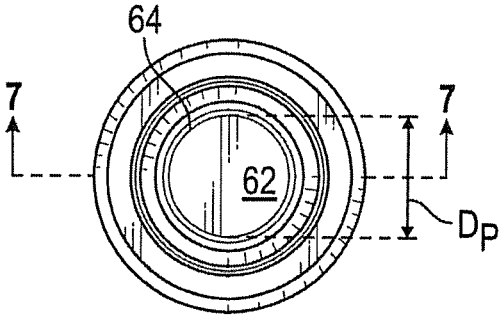
FIG. 6 shows a top view of an embodiment of a disk housing containing a rupture disk which may be utilized with embodiments of the present invention.
Figure 7:
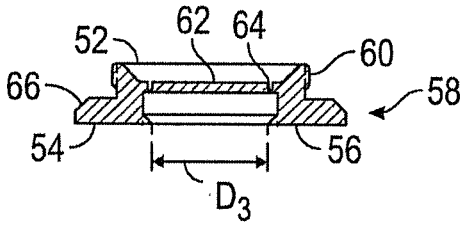
FIG. 7 shows a sectional view of the disk housing depicted in FIG. 6
Figure 8:
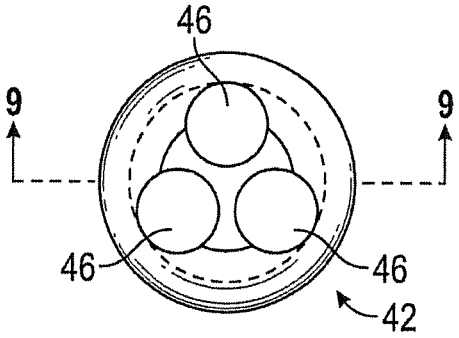
FIG. 8 shows a top view of an embodiment of a flow diffuser which may be utilized with embodiments of the present invention.
Figure 9:
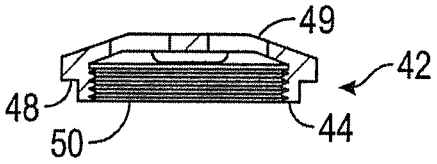
FIG. 9 shows a sectional view of the flow diffuser depicted in FIG. 8.

As shown in FIGS. 4, 5A and 5B, the mandrel 12 has an interior section 26. Adjacent to the interior section 26 is mandrel wall 28. Mandrel wall 28 will typically have a thickness greater adjacent to interior section 26 than the wall thickness at upper end 22 and the lower end 24. Penetrating through mandrel wall 28 into interior section 26 is aperture 30. Aperture 30 defines a second axis $L_2$ which is perpendicular to the central axis $L_1$. Aperture 30 comprises, in relative position from the inside of the mandrel wall 28 to the outside of the mandrel wall, a first section 32 having a first diameter $D_1$ and a second section 34 having a second diameter $D_2$, wherein a first shoulder 36 is defined between the first diameter and the second diameter. The first shoulder 36 has an outwardly facing peripheral surface 38 which faces outwardly and an inwardly facing peripheral sealing surface 40. Inwardly facing peripheral sealing surface 40 may, with respect to second axis $L_2$, form an angle ranging from between approximately 30 to 60 degrees, with 45 degrees being the approximate angle indicated in the figures. Adjacent to aperture 30, the inside of mandrel wall 28 may be scooped out to form scalloped opening 31. The scalloped opening increases the internal volume of the drain 10 directly adjacent to the rupture disk to further reduce the impact of pressure surges which may occur inside the hydraulic drain.

A flow diffuser 42 is disposed within the aperture 30, where the flow diffuser comprises a generally plug-shaped body which is sized to be received within the aperture 30. The flow diffuser has an inside end 44 which is generally facing the interior section 26 of the mandrel 12. Flow diffuser 42 has a peripheral shoulder 48 which, when installed within aperture 30, abuts outwardly facing peripheral surface 38 of first shoulder 36. The flow diffuser 42 has a first set of threads 50 which mate with threads 60 of disk housing 58 as discussed below. Outside end 49 of flow diffuser 42 is generally flush with the exterior of the mandrel wall 28, or slightly recessed within the exterior of the mandrel wall, such that outside end 49 of the flow diffuser 42 does not increase the effective diameter of the drain 10.

The flow diffuser 42 has one or more apertures 46 which extend through the flow diffuser 42, forming a flow passage there through.

Disk housing 58 has an exterior end 52 which is in facing relationship with the inside end 44 of the flow diffuser 42 and an interior end 56 which faces the interior of the mandrel 12. The exterior end 52 has second set of threads 60 which mate with threads 50 of the flow diffuser 42. Peripheral shoulder 54 has a sealing surface 66 which, when disk housing 58 has been made up to flow diffuser 42, forms a metal-to-metal seal with face 40 of first shoulder 36. Sealing surface 66 may be angled to compliment the angle of face 40 which, as discuss above, may have an angle ranging from 30 to 60 degrees, with 45 degrees being the approximate angle indicated in the figures.

A rupture disk 62 is disposed between the exterior end 52 and the interior end 56 of the disk housing 58. Rupture disk 62 is attached to the approximate center of disk housing 58 by a peripheral ring 64 having a reduced wall thickness. When sufficient hydraulic pressure is applied to the rupture disk 62, the rupture disk will sever from the disk housing 58 along the boundary of peripheral ring 64. Peripheral ring 64 has diameter $D_p$ which defines the diameter of the severed rupture disk 62. Diameter $D_p$ is larger than the diameter of the apertures 46 in flow diffuser 42 and the diameter of opening $D_3$ at interior end 56 of disk housing 58. Thus, once separated, the rupture disk 62 will be trapped between the flow diffuser 42 on the outside and the interior end 56 of disk housing 58. This design prevents the rupture disk from moving inwardly and falling down the tubing string or escaping outwardly into the tubing-casing annulus. It is to be appreciated that embodiments of the present invention do not require that aperture 30 have any threads. Instead, the flow diffuser 42 and disk housing 58 are made up to one another, where a shoulder within aperture 30 is sandwiched or captured between the flow diffuser and disk housing. This method of installing the flow diffuser and disk housing reduces the possibility of damage to the mandrel 12.

The mandrel 12 will be manufactured from materials having the mechanical properties and material composition suitable for high tensile loads in a potentially corrosive environment. For example, the mandrel may be manufactured from 3.5 inch round bar complying with AISI 1018 ASTM A108. The flow diffuser 42 and disk housing 58 may be manufactured from 2.0 inch round bar of 17-4 PH (precipitation hardened) H925 to H1025 condition (heat treat condition). The disk housing 58 may be manufactured from 1.75 inch stock round bar of 316 stainless steel, where the rupture disk is rated to shear at a variety of burst pressures, including 3,000 to 7,000 psi.

While the above is a description of various embodiments of the present invention, further modifications may be employed without departing from the spirit and scope of the present invention. Thus the scope of the invention should not be limited according to these factors, but according to the following appended claims.

What is claimed is:

1. A hydraulically actuated drain for draining a tubing string in a well, the hydraulically actuated drain comprising:

a mandrel having an upper end, a lower end, with an axially-aligned opening defined within a mandrel wall, the mandrel wall having an inside and an outside, the axially-aligned opening extending between the upper end and the lower end, wherein a central axis is defined between the upper end and the lower end;

the mandrel comprising an aperture which extends radially through the mandrel wall, the aperture defining a second axis perpendicular to the central axis, wherein the aperture comprises, in relative position between the inside of the mandrel wall and the outside of the mandrel wall, a first section having a first diameter and a second section having a second diameter, wherein a first shoulder is defined between the first diameter and the second diameter, the first shoulder comprising an outward face, the first shoulder further comprising an inward face, the inward face comprising a first sloping sealing surface;

a flow diffuser disposed in the aperture, the flow diffuser comprising an inside end generally facing the inside of the mandrel wall and an outside end generally flush with the outside of the mandrel wall, the flow diffuser comprising one or more flow passages extending from the inside end to the outside end, the flow diffuser comprising a peripheral shoulder adapted to abut the outer face of the first shoulder of the mandrel, the flow diffuser further comprising a first set of threads adjacent to the inside end;

a disk housing having an exterior end in facing relationship with the flow diffuser and an interior end facing the interior portion of the mandrel, the exterior end having a second set of threads adapted to mate up to the first set of threads of the flow diffuser, the exterior end further comprising a peripheral shoulder comprising a second sloping sealing surface adapted to seal against the first sloping sealing surface when the first set of threads of the flow diffuser are made up to the second set of threads of the disk housing; and a rupture disk disposed between the exterior end and the interior end of the disk housing.

2. The hydraulically actuated drain of claim 1 wherein the interior end of the disk housing has an opening having a diameter and the rupture disk has a rupture disk diameter greater than the diameter of the opening of the interior end.

3. The hydraulically actuated drain of claim 2 wherein the rupture disk is attached to the inside of the disk housing by a peripheral attachment ring where upon application of a hydraulic pressure, the rupture disk detaches from the disk housing along the peripheral attachment ring and the rupture disk becomes trapped between the disk housing and the flow diffuser.

4. The hydraulically actuated drain of claim 1 wherein a metal to metal seal is formed between the first sloping sealing surface and the second sloping sealing surface, the metal to metal seal sufficient, without an o-ring seal, to prevent a flow of a fluid through the aperture until the rupture disk detaches from the disk housing.

5. The hydraulically actuated drain of claim 1 wherein the inside of the mandrel wall is scalloped adjacent to the aperture.

6. A hydraulically actuated drain for draining a tubing string in a well, the hydraulically actuated drain comprising:

a mandrel having an upper end, a lower end, with a axially-aligned opening defined within a mandrel wall, the mandrel wall having an inside and an outside, the axially-aligned opening extending between the upper end and the lower end, wherein a central axis is defined between the upper end and the lower end;

the mandrel comprising an aperture which extends radially outward from the inside of the mandrel wall to the outside of the mandrel wall, the aperture defining a second axis perpendicular to the central axis, wherein the aperture comprises a first shoulder defined between an outer portion of the aperture and an inner portion of the aperture, the first shoulder having an outwardly facing surface and an inwardly facing surface;

a flow diffuser disposed in the aperture, the flow diffuser comprising an inside end generally facing the inside of the mandrel wall and an outside end surface generally adjacent with the outside of the mandrel wall, the flow diffuser comprising a first peripheral shoulder which abuts the outwardly facing surface, the inside end comprising a first set of threads;

a disk housing having an exterior end in facing relationship with the flow diffuser and an interior end facing the inside wall of the mandrel, the exterior end having a second set of threads adapted to mate up to the first set of threads of the flow diffuser, the exterior end further comprising a second peripheral shoulder which abuts the inwardly facing surface when the first set of threads of the flow diffuser are mated up to the second set of threads of the disk housing; and a rupture disk disposed between the exterior end and the interior end of the disk housing.

7. The hydraulically actuated drain of claim 6 wherein the interior end of the disk housing has an opening having a diameter and the rupture disk has a rupture disk diameter greater than the diameter of the opening of the interior end.

8. The hydraulically actuated drain of claim 7 wherein the rupture disk is attached to the inside of the disk housing by a peripheral attachment ring where upon application of a hydraulic pressure, the rupture disk detaches from the disk housing along the peripheral attachment ring and the rupture disk becomes trapped between the disk housing and the flow diffuser.

9. The hydraulically actuated drain of claim 6 wherein a metal to metal seal is formed between the second peripheral shoulder and the inwardly facing surface, the metal to metal seal sufficient, without an o-ring seal, to prevent a flow of a fluid through the aperture until the rupture disk detaches from the disk housing.

10. The hydraulically actuated drain of claim 6 wherein the inside of the mandrel wall is scalloped adjacent to the aperture.

11. A hydraulically actuated drain comprising:

a mandrel having an upper end, a lower end, with an axially-aligned opening defined within a mandrel wall, the mandrel wall having an inside and an outside, the axially-aligned opening extending between the upper end and the lower end, wherein a central axis is defined between the upper end and the lower end;

an aperture which extends radially into the mandrel wall, the aperture defining a radial axis, the aperture comprising a circumferential shoulder;

a flow diffuser disposed in the aperture, the flow diffuser having an inside end;

a disk housing having an exterior end engaged with the inside end of the flow diffuser, and the disk housing further comprises an interior end and a rupture disk is disposed between the exterior end and the interior end and the interior end has an opening having a diameter and the rupture disk has a rupture disk diameter greater than the diameter of the opening of the interior end wherein the circumferential shoulder is captured between the flow diffuser and the disk housing effecting a metal-to-metal seal between the disk housing, the flow diffuser, and the circumferential shoulder.

12. The hydraulically actuated drain of claim 11 wherein the rupture disk is attached to the inside of the disk housing by a peripheral attachment ring where upon application of a hydraulic pressure, the rupture disk detaches from the disk housing along the peripheral attachment ring and the rupture disk becomes trapped between the disk housing and the flow diffuser.

13. The hydraulically actuated drain of claim 11 wherein the inside of the mandrel wall is scalloped adjacent to the aperture.

* * * * *